US007141027B2

(12) United States Patent
Kassel et al.

(10) Patent No.: US 7,141,027 B2
(45) Date of Patent: Nov. 28, 2006

(54) LEG STRETCHING MACHINE

(76) Inventors: Arthur Michael Kassel, 511 N. Foothill, Beverly Hills, CA (US) 90210; Kenneth Owen Richardson, P.O. Box 2254, Whittier, CA (US) 90610

( * ) Notice: Subject to any disclaimer, the term of this patent is extended or adjusted under 35 U.S.C. 154(b) by 0 days.

(21) Appl. No.: 11/293,661

(22) Filed: Dec. 2, 2005

(65) Prior Publication Data

US 2006/0074357 A1 Apr. 6, 2006

Related U.S. Application Data

(63) Continuation of application No. PCT/US2004/018003, filed on Jun. 4, 2004.

(60) Provisional application No. 60/475,600, filed on Jun. 4, 2003.

(51) Int. Cl.
*A61H 1/02* (2006.01)

(52) U.S. Cl. ..... 601/5; 601/23; 601/26; 601/34; 482/907

(58) Field of Classification Search ..... 601/5, 601/23, 25–27, 31–35, 97–98; 482/80, 131, 482/136, 137, 139, 907
See application file for complete search history.

(56) References Cited

U.S. PATENT DOCUMENTS

| | | | |
|---|---|---|---|
| 5,122,106 | A | 6/1992 | Atwood et al. |
| 5,207,216 | A | 5/1993 | Sweeny |
| 5,460,596 | A | 10/1995 | Brady |
| 2002/0193710 | A1 | 12/2002 | Main et al. |

FOREIGN PATENT DOCUMENTS

WO WO2004/108052 12/2004

*Primary Examiner*—Quang D. Thanh
(74) *Attorney, Agent, or Firm*—Howard M. Cohn

(57) ABSTRACT

According to the invention, there is disclosed a leg stretching device 10 characterized by a leg support arm 34 mounted to a primary shaft 36 at a first end, the leg support arm having a leg support 38 secured to the leg support arm at a second end; and structure for rotating the primary shaft from an initial position to a final position so that the leg support arm moves through a range of about 30 to 70 degrees and preferably about 40 to 60 degrees. In addition, there are provided structure for adjusting the location of the initial position of the leg support arm 34. In addition, the length of leg support arm 34 is adjustable.

18 Claims, 2 Drawing Sheets

LEG STRETCHING MACHINE

CROSS-REFERENCE TO RELATED APPLICATIONS

This application claims the benefit of U.S. Provisional Patent Application No. 60/475,600 filed on Jun. 4, 2003 which is incorporated herein by reference.

This application is a continuation of copending PCT Patent Application No. PCT/US2004/018003 filed on Jun. 4, 2004, which is incorporated herein by reference.

TECHNICAL FIELD

The present invention generally relates to a stretching machine and more particularly to a leg stretching machine for use by a person to facilitate the stretching of their legs.

BACKGROUND OF THE INVENTION

It has long been known that for individuals who have limited mobility of their limbs, regular exercise can provide significant benefits. Such individuals, who may have suffered a spinal injury, stroke, multiple sclerosis (MS), muscular dystrophy (MD), or other similar injury or disorder that impairs mobility (either temporarily or permanently), may also find that their impairments can even present significant obstacles to exercising other relatively unaffected body parts.

Regular movement of all major body parts has been shown to be necessary to promote the comfort, health and general well-being of individuals suffering from such disabilities. A failure to do so can have painful, even unhealthful and dangerous consequences. For example, immobility tends to lead rapidly to stiffened and painful joints and tendons. In the longer term, atrophy of unused and underused muscles can occur. A greater susceptibility to the formation of blood clots has been demonstrated. Long-term immobility also leads to an overall deterioration of the cardiovascular system.

By way of contrast, when impaired limbs are regularly exercised (e.g., when subjected to repeated manual extensions by a physical therapist), joints tend to become more flexible, circulation is improved, the tendency to atrophy is reduced, the heart tends to work more efficiently, and the patient tends to experience less pain and discomfort. While the benefit of such exercise is indisputable, it can require considerable time and effort of both the afflicted individual and the assistant (therapist or volunteer).

SUMMARY OF THE INVENTION

According to the invention, there is disclosed a leg stretching device 10 characterized by a leg support arm 34 mounted to a primary shaft 36 at a first end, the leg support arm having a leg support 38 secured to the leg support arm at a second end; and means for rotating the primary shaft from an initial position to a final position so that the leg support arm moves through a range of about 30 to 70 degrees and preferably about 40 to 60 degrees. In addition, there are provided means for adjusting the location of the initial position of the leg support arm 34. In addition, the length of leg support arm 34 is adjustable.

Further according to the invention, there is provided a machine casing 12 having a base 14, two sidewalls, 16, 18, a front wall 20 and a rear wall 22 and a sloping top 24. A hand support 28 attached to the machine casing. The hand support 28 includes a support arm 30 attached to the machine casing 12, and a handle 32 that is pivotally attached onto the support arm 30 and a hand grip 33 pivotally secured to the support arm 30.

Still further according to the invention, there is provided a foot support arm 40 that is secured to an end of the leg support arm 34 having a foot support 42 extending therefrom. The foot support arm 40 is disposed at an angle "a" of about 30 degrees to about 70 degrees and preferably 40 degrees to about 60 degrees with respect to leg support arm 34.

According to the invention, there is disclosed a method of stretching a user's legs comprising the steps of: providing a leg stretching device 10 having a leg support arm 34 with a leg support 38 extending there from, the leg support arm 34 being rotated from an initial position to a final position so that the leg support moves through a range of about 30 to 70 degrees; placing at least one of the user's legs on the leg support 38; and moving the leg support from the initial position to a final position.

Further according to the invention, there is disclosed the steps of: providing characterized by a foot support arm 40 that is secured to an end of the leg support arm 34, the foot support arm having a foot support 42 extending therefrom; and pressing at least one of the user's feet against the foot support.

Still further according to the invention, there is disclosed the step of setting the initial position of the leg support arm 34 and keeping the leg support arm 34 in the second position for a set period of time such as 10 to 20 seconds.

BRIEF DESCRIPTION OF THE DRAWINGS

These and other features of the present invention will be apparent with reference to the following description and drawings wherein.

DETAILED DESCRIPTION OF THE PRESENT INVENTION

Figure 1:
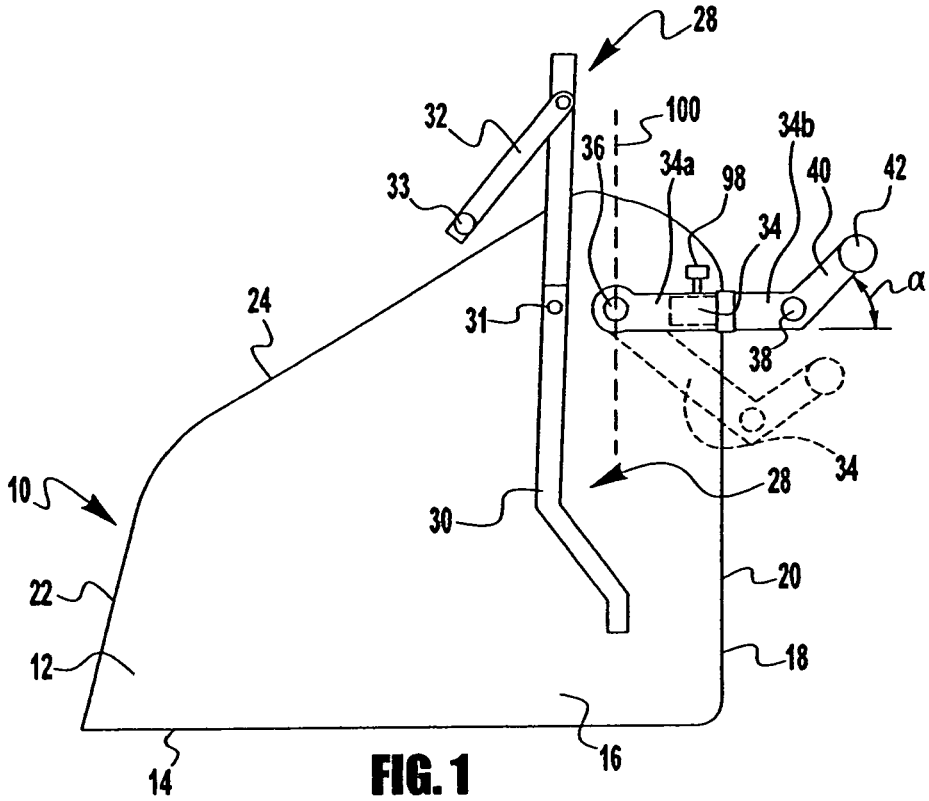
FIG. 1 is a side view of the leg stretching device of the present invention.

Referring to FIG. 1, there is shown a side view of a leg stretching device 10 including a machine casing 12 having a base 14, two sidewalls, 16, 18, a front wall 20 and a rear wall 22 and a sloping top 24. An electrical control panel 26 are disposed on the top 24 (see FIG. 2).

A hand support 28 includes a support arm 30, which is attached to the machine casing 12, and a handle 32 that is pivotally attached onto the arm 30 and includes a hand grip 33. The arm 30 is adjustable so as to be able to position the handle 32 up and down, closer and further from the base 14 and can be locked into position with a lock pin 31.

Figure 2:
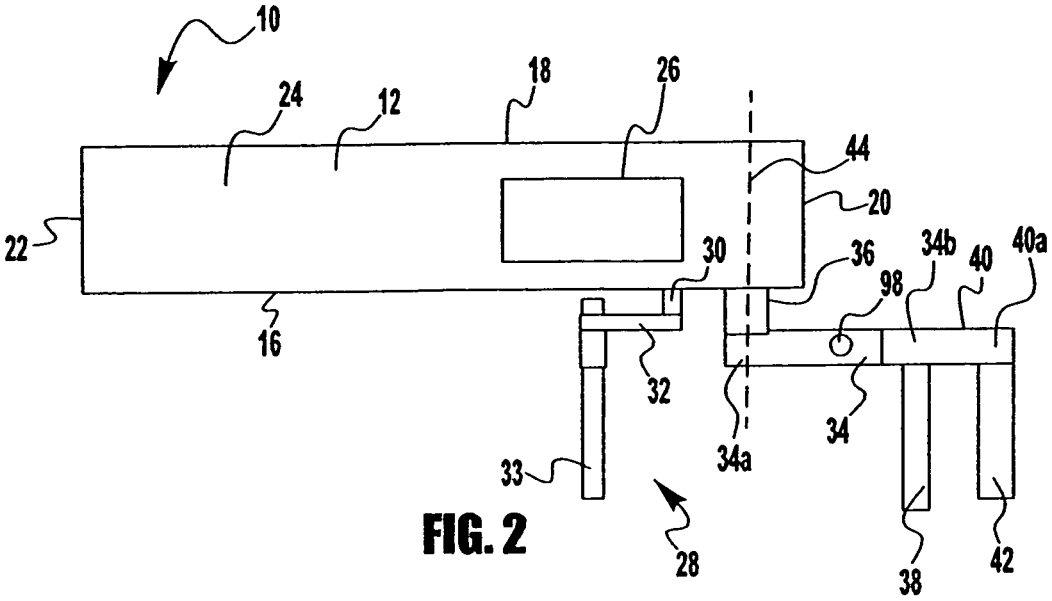
FIG. 2 is a top view of the leg stretching device of the present invention

The leg stretching device 10 includes a leg support arm 34 which is affixedly mounted to a primary operating shaft 36 at one end **34*a* and has a cylindrical leg support 38 secured to the other end 34***b*. The length of leg support arm 34 is adjustable with a telescoping fitting and can be locked into place with a lock pin 98. The leg support 38 extends at a 90 degree angle to the arm 34 as shown in FIG. 2. In addition, a foot support arm 40 that is secured to the end 34*b* of arm 34 at an angle "a" of about 30 degrees to about 70 degrees and preferably about 40 to 50 degrees. The foot support arm 40 has a cylindrical foot support 42 that extends substantially perpendicularly outwards from the free end 40*a* of foot support arm 40. The foot support 42 is provided to press against the bottoms of the user's feet while the user's ankle area, i.e. the Achilles tendon, is supported by the leg support 38.

In operation, the operating shaft 36 rotates arm 34, preferably about 20 degrees between a position shown in dotted lines to the position shown in solid line in FIG. 1. As will be better understood hereinafter, that movement of the leg support 38 tends to stretch a person's legs.

Figure 3:
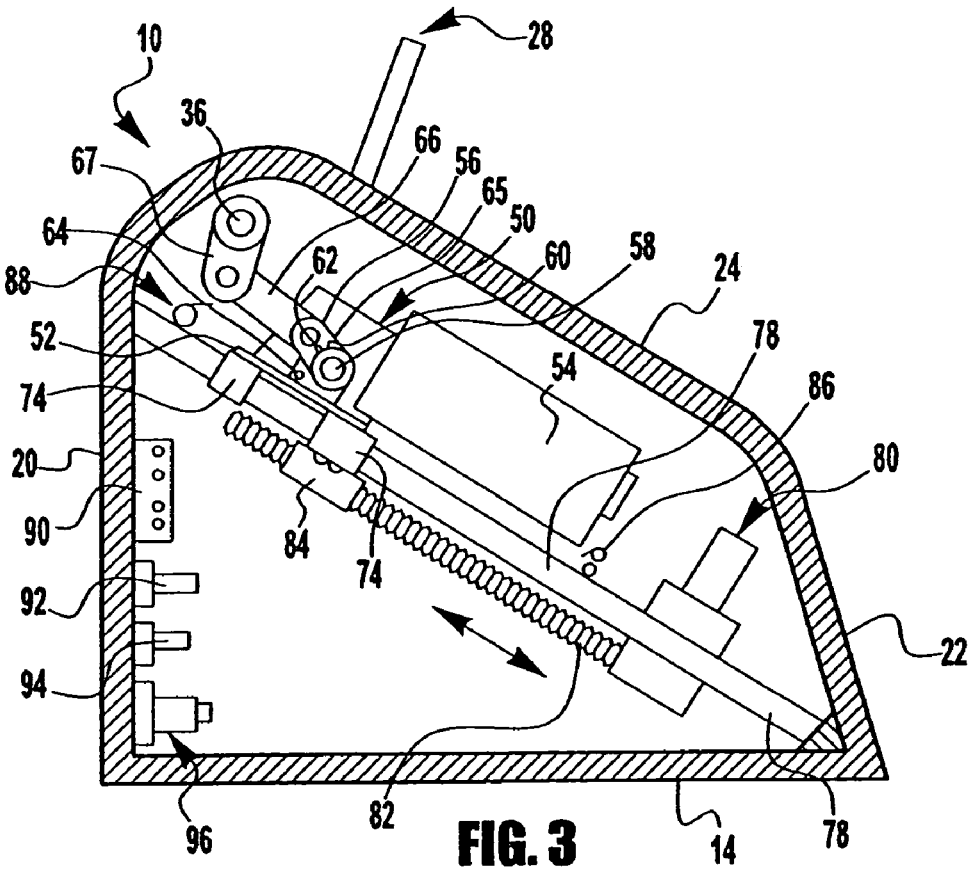
FIG. 3 is a cross-sectional view of the leg stretching device of the present invention.
Figure 4:
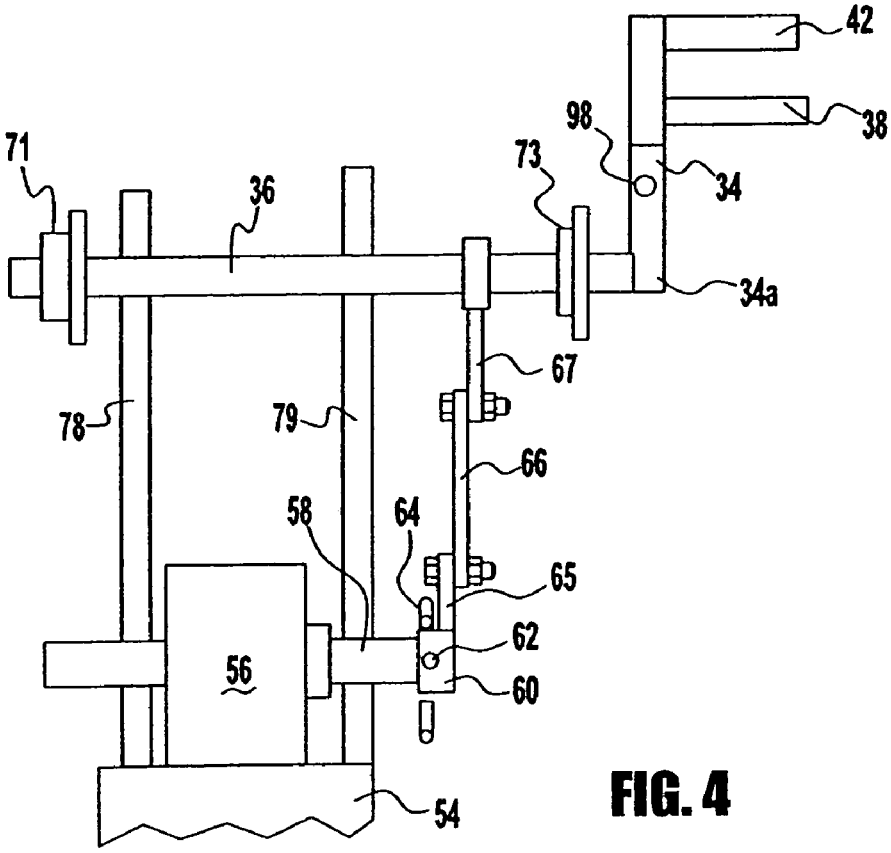
FIG. 4 is a top view of a portion of the operating mechanism of the leg stretching device of the present invention

Referring to FIG. 3, there is shown the operating mechanism means for the leg stretching device 10 of the present invention. The operating mechanism means includes a motor and gear box assembly 50 that is mounted onto a motor base bracket 52. The motor 54 is attached to the gear box 56. Extending outward from the gear box 56 is a gear box shaft 58. As best seen in FIGS. 3 and 4, an end fitting 60 secured to the end of the gear box shaft 58 has a protrusion 62, which activates a micro-switch 64, which in turn, turns off the motor 54. A linkage arm 65 is affixed to the fitting 60. Linkage arm 65 in turn is bolted to a second linkage arm 66. Linkage arm 66, in turn, is bolted at a second end to linkage arm 67 which in turn is secured to the main shaft 36.

The main shaft 36 is attached by bearings 71,73 secured to the opposite sidewalls 16, 18 of the machine casing 12. One end of the main shaft 36 protrudes outward from the sidewall 16 and is attached to the arm 34 (as shown in FIG. 1) so as to move the arm 34 through an arc angle of about 30 to about 70 degrees and preferably about 40 to 50 degrees from the position shown in dotted lines in FIG. 1 to the position shown as a solid line.

As best seen in FIG. 3, the motor base bracket 52 is secured by two pairs of sleeve flanges 74, 76 (not shown), which in turn are slidably mounted onto two slide shafts 78,79 (see FIG. 4) that extend across the casing 12. An adjustment motor 80 is secured to the slide shaft 78 and drives an elongated threaded rod 82 that is threadably received within a threaded sleeve 84. Sleeve 84, in turn, is attached to the sleeve flange 74. There is a switch 86 attached to the slide shaft 78 near the motor 80 and another switch 88 secured to the slide shaft 78 near the front end 20 of the casing 12.

The adjustment motor 80 operates in two directions to turn the threaded rod 82 and thereby rotate the main shaft 36 so as to adjust the starting position of the arm 34 (to the dotted position in FIG. 1). As the arm 34 pivots downward into a position more parallel to axis 100 extending through shaft 36 (See FIG. 1), the user does not have to straighten out their legs as much when the arm swings 34 through its range of movement of about 30 to 60 degrees and preferably about 45 degrees.

The adjustment motor 80 is operated by a switch (not shown) on the electrical control panel 26 shown in FIG. 2. The range of movement of the sleeve flange 74 to which the motor bracket 52 is secured is limited by the two micro-switches 86, 88. When the motor 80 causes the motor 54 to move in the direction of motor 80, the end of motor 54 will contact the micro-switch 86 and stop the motor 80. When the motor 80 turns in the opposite direction, the motor bracket 52 contacts the switch 88 and thereby turns off the motor 80, which prevents the main shaft 36 from moving any further away from the front side 20 of the casing 12.

Referring to FIG. 3, there is shown a d/c converter 90 for operating the motor 54. A relay 92 is provided for stopping the motor 54 when the main shaft 36 has turned so that the leg support 38 is at the highest point and relay 94 is provided for stopping the motor 54 when the main shaft 36 has turned so that the leg support 38 is at the lowest point. Note that a time relay 96 is provided for holding the leg support 38 at the upper position for a set period of time.

In operation, the user sits in a chair, such as a wheelchair, and places one or both of their legs onto the leg support 38 and rests them there upon their Achilles tendon. At the same time, the bottom of the user's feet are pressed against the foot support 42. The position of the leg support 38 and foot support 42 with respect to the front 20 of the machine 10 can be adjusted and locked into place with an adjustment knob 98, as shown in FIGS. 1 and 2. The initial angle at which the arm 34 is disposed with respect to a center line 100 through the main shaft 36 is set by the user with a switch (not shown) on the electrical control panel 26. The switch activates the adjustment motor 80 and causes the screw 82 to turn so that the linkage arm 60 moves the linkage arms 66 and 67 to adjust the position of the main shaft 36.

Once the person has their legs in place on the support 38, they can hold onto the handle 32 and start the leg stretching device. The motor 54 operates and turns the shaft 58, which turns sleeve 60 in a circular direction around the shaft 58. As the sleeve 60 moves around, it causes the arm 65 to rotate which in turn causes arm 66 attached thereto to move backward and forward. The movement of arm 66 in turn, causes the arm 67 attached thereto to rotate the main shaft 36 through an arc of about 30 to 70 degrees and preferably about 40 to 50 degrees. The rotation of main shaft 36, in turn, causes the arm 34 to move from the lower position, as shown in dotted line in FIG. 1 to the position shown in solid line. This movement causes the person's leg to be stretched out.

As the shaft 58 is turning, a protrusion 62 engages the micro-switch 64, which in turn turns off the motor 54. Meanwhile, when the leg support 38 reaches the highest position, the time delay 96 is triggered and causes a delay, i.e. about 20 seconds, before the relay 92 turns the motor 54 back on so that the cycle continues and the leg support moves down to its lowest position.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components, the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. A leg stretching device comprising:

a leg support arm mounted to a primary shaft at a first end, the leg support arm having a leg support secured to the leg support arm at a second end;

a motor and gearbox assembly connected by a linkage arm assembly to the primary shaft for rotating the primary shaft from an initial position to a final position so that the leg support arm moves through a range of about 30 to 70 degrees; and at least one slide shaft onto which the motor and gearbox assembly is slidably mounted for adjusting the location of an initial position of the leg support arm.

2. The leg stretching device of claim 1 wherein the motor and gearbox assembly connected by a linkage arm assembly to the primary shaft for rotating the primary shaft moves the leg support arm through a range of about 40 to 60 degrees.

3. The leg stretching device of claim 1 further comprising:

an adjustment motor secured to the slide shaft for moving the motor and gearbox assembly along the length of the slide shaft and adjusting the location of the initial position of the leg support arm.

4. The leg stretching device of claim 1 further comprising means for keeping the primary shaft in a final position and the leg support arm in a final position for a set period of time.

5. The leg stretching device of claim 1 further comprising a machine casing having a base, two sidewalls, a front wall and a rear wall and a sloping top.

6. The leg stretching device of claim 5 further comprising a hand support attached to the machine casing.

7. The leg stretching device of claim 6 wherein the hand support includes a support arm attached to the machine casing, and a handle that is pivotally attached onto the support arm and a hand grip pivotally secured to the support arm.

8. The leg stretching device of claim 1 wherein the length of leg support arm is adjustable.

9. The leg stretching device of claim 1 further comprising a foot support arm that is secured to an end of the leg support arm having a foot support extending therefrom.

10. The leg sketching device of claim 9 wherein the foot support arm is disposed at an angle "a" of about 30 degrees to about 70 degrees with respect to the leg support arm.

11. The leg stretching device of claim 10 wherein the foot support arm is disposed at an angle "a" of about 40 degrees to about 60 degrees with respect to the leg support arm.

12. The leg sketching device of claim 11 wherein the leg support and the foot support extending perpendicularly outwards from the leg support arm and the foot support arm, respectively.

13. The method of stretching a user's legs comprising the steps of:

providing a leg stretching device having a leg support arm mounted to a primary shaft at a first end of the leg support arm and a leg support extending from a second end of the leg support arm;

providing a motor and gearbox assembly connected by a linkage arm assembly to the primary shaft for rotating the leg support arm from an initial position to a final position so that the leg support moves through a range of about 30 to 70 degrees;

slidably mounting the motor and gearbox assembly for adjusting the location of an initial position of the leg support arm;

placing at least one of the user's legs on the leg support; and moving the leg support arm from the initial position to a second position.

14. The method of claim 13 further including the steps of:

providing a foot support arm that is secured to an end of the leg support arm, the foot support arm having a foot support extending therefrom; and pressing at least one of the user's feet against the foot support.

15. The method of claim 14 further including the step of setting the initial position of the leg support arm.

16. The method of claim 14 further including the step of keeping the leg support arm in second position for a set period of time.

17. The method of claim 14 further including the step of keeping the leg support arm in the second position for a period of time of 10 to 20 seconds.

18. The method of claim 13 further including the step of:

providing at least one slide shaft onto which the motor and gearbox assembly is slidably mounted; and adjusting the location of the initial position of the leg support arm by moving the motor and gearbox assembly along the length of the slide shaft with an adjustment motor secured to the slide shaft.

* * * * *